US005384442A

United States Patent [19]

Danner

[11] Patent Number: 5,384,442

[45] Date of Patent: Jan. 24, 1995

[54] CONTROL KNOB ASSEMBLY FOR A COOKING APPLIANCE

[75] Inventor: Richard E. Danner, Troy, Ohio

[73] Assignee: Whirlpool Corporation, Benton Harbor, Mich.

[21] Appl. No.: 846

[22] Filed: Jan. 5, 1993

[51] Int. Cl.[6] ..... H01H 13/62

[52] U.S. Cl. ..... 200/566; 200/564; 200/336; 200/567

[58] Field of Search ..... 200/566, 565, 564, 567, 200/526, 528, 524, 336; 74/504, 553, 554

[56] References Cited

U.S. PATENT DOCUMENTS

| | | | |
|---|---|---|---|
| 3,100,404 | 8/1963 | Boeddeker et al. | 74/553 |
| 3,269,211 | 8/1966 | McGarry | 74/554 |
| 4,037,490 | 7/1977 | Wilson | 74/553 |
| 4,201,096 | 5/1980 | Morrison et al. | 74/531 |
| 4,300,525 | 11/1981 | Delgado et al. | 126/42 |
| 4,700,646 | 10/1987 | Kamiya | 74/554 |

*Primary Examiner*—Ernest G. Cusick

*Assistant Examiner*—David J. Walczak

*Attorney, Agent, or Firm*—Thomas J. Roth; Robert O. Rice

[57] ABSTRACT

A control knob assembly for a cooking appliance includes a control knob and a track body disposed in the control knob. A ring-shaped bezel having a plurality of inwardly projecting guide followers is mounted to the control knob, whereby the guide followers ride in tracks disposed within a top surface of the track body. The control knob is slidable over the track body, and is alternatively locatable in extended and retracted positions. When the control knob is located in a retracted position, the guide followers are releasably secured in notches contained in the tracks. When depressed, the guide followers are disengaged from the notches, permitting the control knob to move to an extended, operating position. In the operating position, the user depresses the control knob, thereby engaging a second plurality of notches which permit operation of a two-step gas valve by sequentially depressing and rotating the control knob.

9 Claims, 2 Drawing Sheets

CONTROL KNOB ASSEMBLY FOR A COOKING APPLIANCE

BACKGROUND OF THE INVENTION

The present invention is directed to a control knob assembly for a cooking appliance and particularly to a control knob assembly for a gas cooking appliance including a pop-out control knob located in a knob housing within the control panel of the cooking appliance, for providing a flush-appearing control panel surface when the cooking appliance is not in use, and for providing a two-step actuation control of the cooking appliance when it is desired to energize the cooking appliance.

A safety requirement of the American Gas Association is that, in order to open a gas valve in a cooking appliance, a two step operation must be used. Typically, such an operation includes a first step of depressing or pushing a knob, and a second step of turning a knob to select a desired setting. Existing gas valves or power switches designed for use in cooking appliances are designed to accommodate the required two-step operation, typically by incorporating a spring-loaded actuator shaft which must be axially displaced to release a catch before being rotated to select a desired setting.

U.S. Pat. No. 3,100,404, Boeddeker et al., discloses a retractable knob for use with a rotatable power switch in a cooking appliance. A spring clip captures a shaft end when the control knob is depressed, thereby positively latching the knob in the retracted position. To release the control knob, a release member comprising an annular member moves along the shaft to release the clip. The control knob is urged forwardly by a spring, and moves to an extended position where it may be grasped by the user. A disadvantage to the disclosed knob is that operation of the knob in a two-step operation is not enabled. A further disadvantage to the disclosed knob is that the mechanism for operating the control switch remains engaged when the control knob is depressed to retract the knob, potentially permitting inadvertent actuation of the power switch.

U.S. Pat. No. 3,269,211, McGarry et al., discloses a retractable control knob for use with a rotatable power switch in a cooking appliance. A spring is captured by a catch element when the control knob is depressed, thereby retaining the knob in a recessed position. When it is desired to release the control knob, the handle is depressed inwardly, thereby releasing the spring, and accordingly the control knob, which is spring-loaded to automatically extend to a usable position. A disadvantage to the disclosed knob is that operation of the knob in a two-step operation is not enabled. A further disadvantage to the disclosed knob is that the mechanism for operating the control switch remains engaged when the control knob is depressed to retract the knob, potentially permitting inadvertent actuation of the power switch.

U.S. Pat. No. 4,300,525, Delgado et al., discloses a non-retractable two-step knob assembly for a gas cooking appliance. A cam portion on the control knob shank displaces a spring-loaded member when the knob is rotated to an "off" position, which member then returns to an extended position after the raised cam portion passes by, thereby preventing one-step rotation of the knob assembly once the knob assembly is placed in the "off" position. The valve may be opened by pushing the knob assembly inwardly, which compresses a spring contained within the knob assembly. The cam moves forwardly to clear the spring-loaded member, thereby permitting the knob assembly to be rotated to an "on" position. While the described arrangement permits two-step operation, a retractable control knob for a cooking appliance is not provided.

The present invention overcomes the disadvantages of the previous control knobs for cooking appliances by providing a retractable two-step knob assembly for a cooking appliance. More particularly, the present invention includes a knob assembly which both provides a means for sequentially depressing a valve or switch shaft, then rotating the shaft.

An advantage of the present invention is the capability of providing two-step operation of a valve or switch, while permitting retraction of the knob to provide additional safety and a flush control panel surface appearance. A further advantage of the present invention is to provide a control knob assembly which may be retracted only when the control or switch is in an "off" position. Yet another advantage of the present invention is the ability to provide a retractable two-step switch, which is prevented from inadvertent movement to an "on" position when the control knob is in the retracted position.

Yet another advantage of the present invention is the ability to provide a retractable, two-step switch which requires a minimum number of components, for reduced cost, improved ease of manufacture, and increased reliability. A further advantage of the present invention is improved tactile response and feedback to the user.

SUMMARY OF THE INVENTION

In accordance with the present invention, the disadvantages of the prior art control knob assemblies for cooking appliances have been overcome. A control knob assembly includes a control knob body which is axially movable within a knob housing. The control knob body includes a generally hollow interior area in which is slidably disposed a track body or drum. A valve or switch shaft extends longitudinally and is disposed within a channel which extends into the track body, and a shaft is axially and radially engaged by the track body and movable therewith.

In another aspect of the invention, the track body includes a plurality of guide tracks in its outer surface. A ring-shaped ratchet is removably secured by the control knob and includes a plurality of inwardly projecting pins or guide followers in equal numbers to the aforementioned guide tracks. Each guide track includes a plurality of detents for capturing and retaining the guide follower in retracted and extended positions, respectively.

In yet another aspect of the present invention, the knob body is spring-loaded by a control knob spring against the track body, so that when the guide followers are released from the notch by depressing the control knob, the control knob is urged by the spring to an extended, operative position. Furthermore, an extension from the control knob engages a series of steps on the interior wall of a bezel, providing tactile feedback to the user, thereby indicating change in the operating condition of the gas valve.

In operation, the control knob is depressed inwardly by the user, which disengages the guide followers from detents located within the guide tracks. The control knob is urged outwardly over the track body by the control knob spring, whereupon, the guide followers move along the guide tracks until the control knob is fully extended. Accordingly, the control knob may then be depressed and rotated in order to energize the cooking appliance. When it is desired to de-energize the cooking appliance, the control knob is rotated to the "off" position and is then urged inwardly to a retracted position within the control panel, where it provides a flush appearance within the cooking appliance.

DESCRIPTION OF THE PREFERRED EMBODIMENTS

Figures 1, 2, 3:
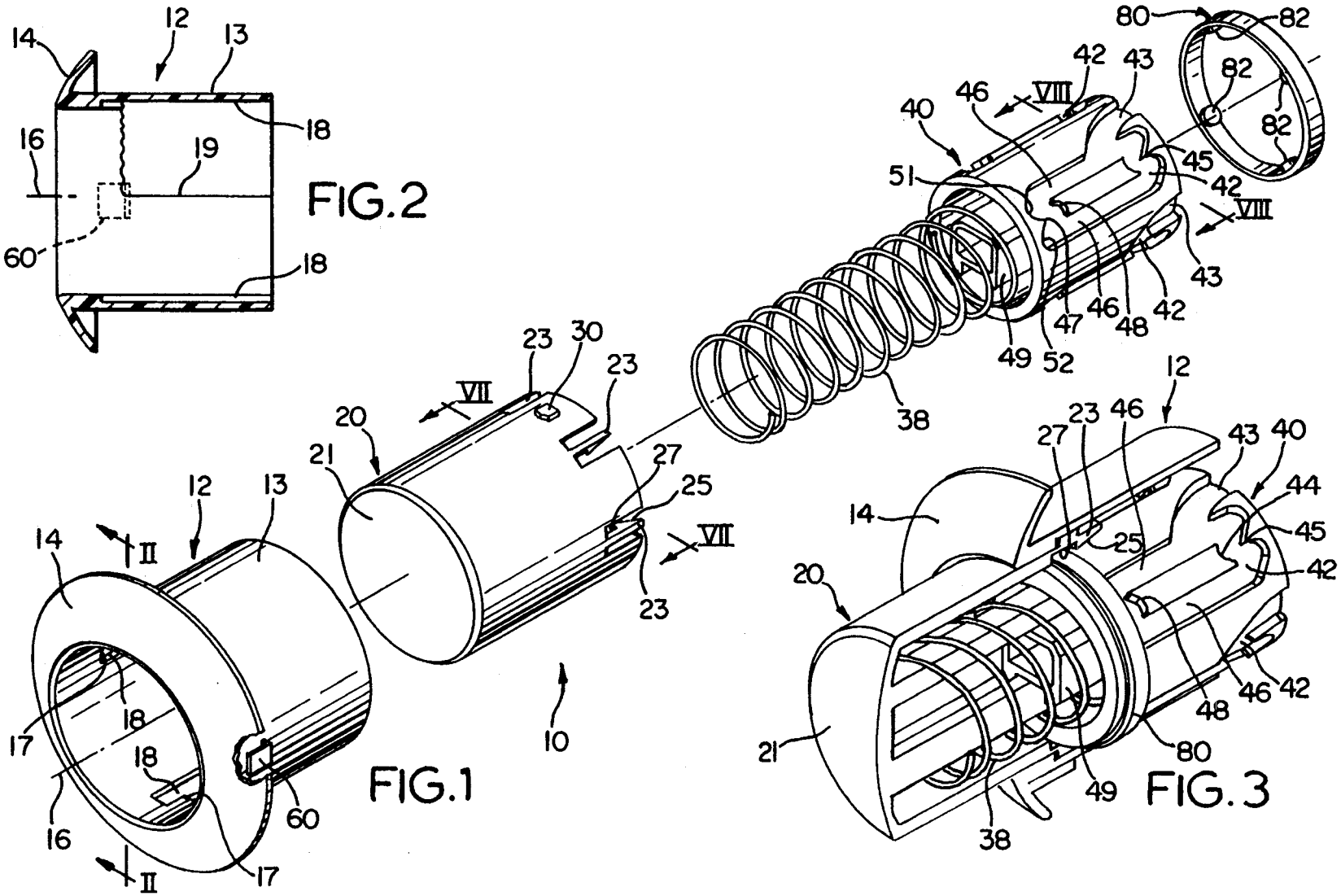
FIG. 1 shows a perspective exploded view of the control knob assembly.
FIG. 2 shows a cross-sectional view of the knob housing, with the knob housing cut away on line II—II of FIG. 1.
FIG. 3 shows a partially cut away perspective view of the control knob assembly, with the knob body in an extended position.

In accordance with the invention as shown in the drawings, a cooking appliance (not shown) has a control knob assembly 10 which includes a knob housing 12. Particularly, as shown in FIG. 2, knob housing 12 includes a cylindrical wall 13 defining a cavity and having a longitudinal axis 16. Knob housing 12 is open at each end, and at a front end thereof is a radially extending disc-shaped bezel 14 for locating knob housing 12 within control panel 50 of a cooking appliance. A resilient retainer clip 60 is integrally formed in cylindrical wall 13, which coacts with a similar clip (not shown) located on the opposite side of knob housing 12 to secure knob housing 12 to the control panel 50.

On the interior wall of knob housing 12, a pair of opposed interior longitudinal grooves 18 extend forwardly from the rearward edge of knob housing 12, and terminate at a point rearwardly of the front end of knob housing 12. As shown in FIG. 2, interior circumferential grooves 19 extend along the interior circumference of knob housing 12 from longitudinal grooves 18. The function of the longitudinal grooves 18 and circumferential grooves 19 is discussed hereinafter in further detail.

Figure 7:
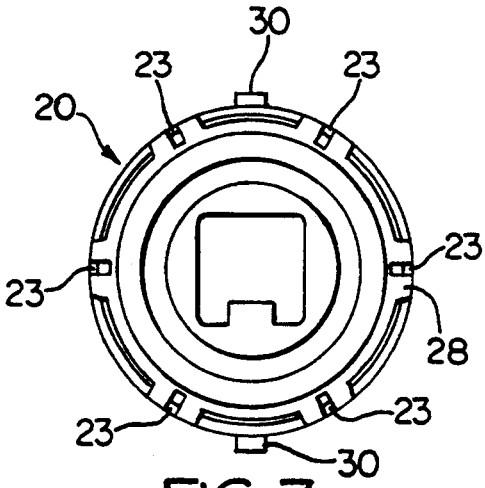
FIG. 7 shows a rear elevational view of the control knob from the viewpoint of line VII—VII in FIG. 1.
Figure 5:
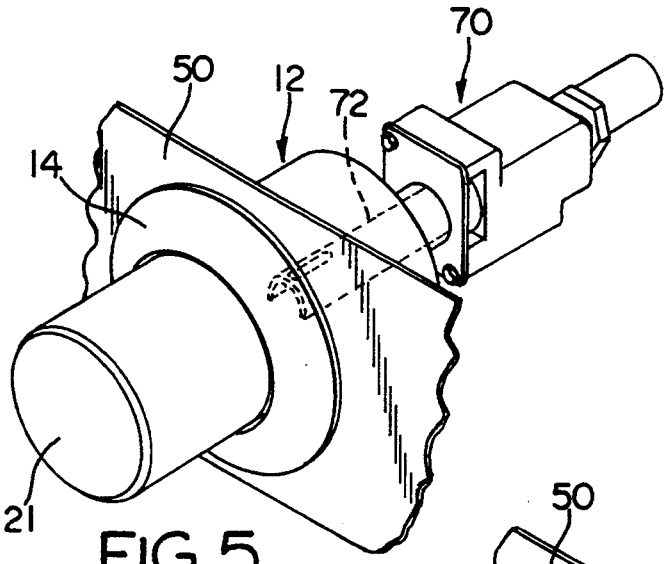
FIG. 5 shows a perspective view of the control knob assembly positioned in a cooking appliance, with the knob body in an extended position.
Figure 6:
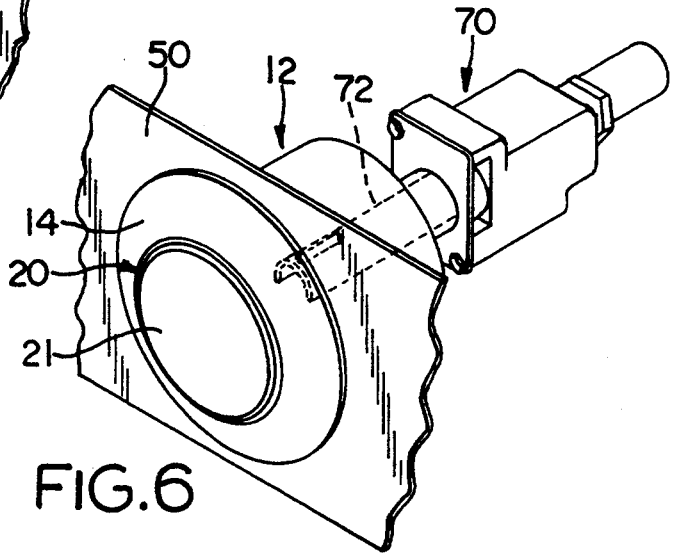
FIG. 6 shows a perspective view of the knob assembly positioned in a cooking appliance, with the knob body in a retracted position.

Control knob 20 is locatable in an extended position, as shown in FIG. 5, and a retracted position, as shown in FIG. 6. Control knob 20 is a generally cylindrical hollow body having an enclosed front end forming a user-depressible knob surface 21. A plurality of resilient retaining hooks 23 are formed in the opposing, open end of control knob 20. Each retaining hook 23 includes an inwardly facing guide surface 25 and retaining slot 27. As shown in FIG. 7, the retaining slot 27 of each retaining hook 23, in conjunction with all other retaining slots 27 and rear wall 28 of control knob 20, defines an interior circumferential groove extending along an entire interior circumference of control knob 20, whose purpose shall become apparent.

In another aspect thereof, control knob 20 includes a pair of opposed outwardly extending bosses 30 disposed on opposite exterior sides thereof. Bosses 30 are positioned so as to be alignable with and slidable within longitudinal grooves 18 and circumferential grooves 19 of knob housing 12.

A generally cylindrical track body or drum 40 is slidable into and positioned within control knob 20. A plurality of tracks 42 are disposed in the exterior wall of track body 40. In track body 40 as shown in FIG. 1, four tracks 42 of similar shape and dimension are utilized. Each track 42 includes at its furthest rearward extent, an inlet guide 43, a notch or detent 44 and a point 45. A pair of guide tracks 46 extend axially along track body 40, and terminate near its forward end. A point 47 and detent 48 are each positioned between guide tracks 46 and the furthest extent of guide tracks 46.

As shown in FIG. 1, an interior projection 49 is formed as part of track body 40, extending to the front end of track body 40. Control knob spring 38 is disposed over projection 49, and is supported by an interior wall (not shown) of track body 40, such that force is exerted thereby on control knob 20. Control knob spring 38 causes control knob 20 to move forwardly to the forward limit of longitudinal grooves 18 when control knob 20 is released from the retracted position.

Figure 8:
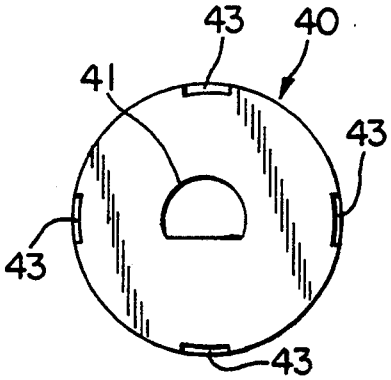
FIG. 8 shows a rear elevational view of the track body from the viewpoint of line VIII—VIII in FIG. 1.

In another aspect thereof, track body 40 includes an opening 41 in the opposite end of track body 40 as shown in FIG. 8. Opening 41 is formed such that gas valve shaft 72 may be received therein, thereby engaging gas valve shaft 72, so that rotation of track body 40 causes rotation of gas valve shaft 72. A ring-shaped ratchet 80 includes a plurality of inwardly projecting pins or guide followers 82, the number of which corresponds in a one-to-one relationship with the number of tracks 42. In the embodiment shown in FIG. 1, four guide followers 82 are included.

Gas valve 70 consists of a standard two-step operation gas valve, as is well known. An example of such a gas valve is that manufactured under the trade name Harper/Wyman, Model 1852. Gas valve shaft 72 is moved rearwardly to disengage a lock or catch (not shown), whereupon, gas valve shaft 72 may be freely rotated to a selected operating position.

In the retracted position, control knob 20 remains nominally flush with bezel 14 of knob housing 12. To move control knob 20 to the extended position, the user presses depressible knob surface 21, thereby disengaging guide followers 82 from detents 44 of track 42 and releasing control knob 20. Control knob spring 38 forces control knob 20 forwardly within knob housing 12, permitting guide followers 82 to travel forwardly on guide tracks 46 until reaching their furthermost forward extent, guide followers 82 resting in a shunt position in a first recess 51 whereupon forward travel of control knob 20 is halted.

With control knob 20 in the fully extended position, guide followers 82 are positioned directly forwardly of detents 48, as shown in FIG. 3. To actuate the valve, the user grasps control knob 20 and pushes inwardly, thereby engaging guide followers 82 with detents 48. As the user continues to push inwardly, the rearward motion is transmitted from control knob 20 through guide followers 82, which forces detents 48, and thereby track body 40, rearwardly. Track body 40 displaces gas valve shaft 72 rearwardly, thereby disengaging the lock or catch associated therewith, and permitting the user to rotate the knob counterclockwise to a selected operating position.

As shown in FIG. 2, circumferential groove 19 extends part way around the interior circumference of bezel 14. When control knob 20 is rotated within bezel 14 to an operating position, bosses 30 of control knob 12 ride along serrated edge 17, thereby prohibiting disengagement of guide followers 82 from detents 48. Serrated edge 17 provides the additional function of providing tactile feedback to the user as control knob 20 is moved between operating positions.

Furthermore, when control knob 20 is in a non-off operating position, the engagement of guide followers 82 with detents 48 prevents axial movement of control knob 20 within knob housing 12, so that the control knob 20 may not be placed in a retracted position.

Figure 4:
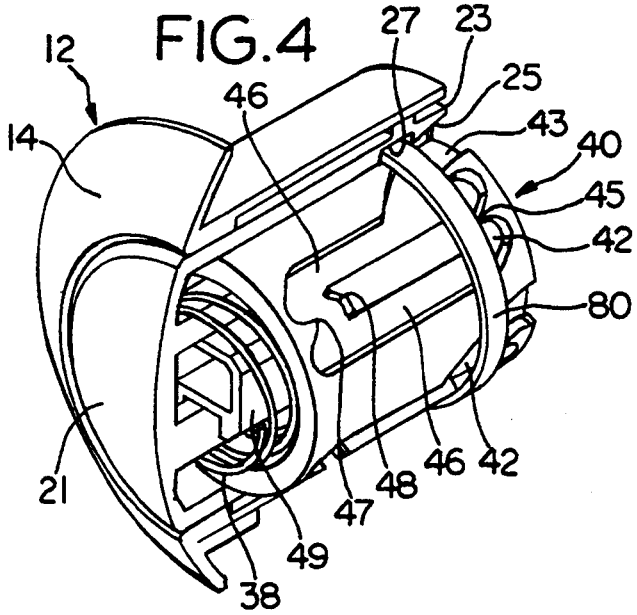
FIG. 4 shows a partially cut away perspective view of the control knob assembly, with the knob body in a retracted position.

When it is desired to de-energize gas valve 70, control knob 20 is rotated to a preselected off position. The user releases any forward pressure on control knob 20, permitting control knob 20 to move to its extreme forward position within bezel 14, and correspondingly, the guide followers 82 move to their extreme forward position within guide tracks 46. In the extreme forward position point 47 directs guide followers 82 into a second recess 52. To retract control knob 20, the user presses depressible knob surface 21 of control knob 20, compressing control knob spring 38 and moving guide followers 82 rearwardly from detent recess 51 along guide track 46. As guide followers 82 reach the furthermost rearward extent of guide track 46, points 45 direct guide followers 82 into detents 44, thereby capturing control knob 20 in a retracted position, as shown in FIG. 4.

If the control knob 20 has not been axially moved against detent 48 and/or rotated to the energized position, it may be rotated from the shunt position, thereby causing guide followers 82 to ride over point 47 from recess 51 into recess 52. Thereafter, the control knob 20 may be retracted as heretofore described.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

What is claimed is:

1. A control knob assembly for a cooking appliance comprising:

a cylindrical control knob having a depressible, closed end and a second, open end;

said control knob defining an axis and being movable axially and locatable in a first, retracted non-operating position, and a second, extended operating position;

said control knob further being rotatable about said axis when in said extended operating position to permit selection between energized and non-energized positions;

a cylindrical drum slidable within said control knob;

said control knob moveable from said extended operating position to said retracted non-operating position after movement to said energized position, and, by rotation of said control knob about said axis prior to movement to said energized position to selectively permit said control knob to slidably move axially with respect to said cylindrical drum.

2. The control knob assembly of claim 1, further comprising means for releasably coupling said control knob to said cylindrical drum for rotating said cylindrical drum with said control knob when said control knob is in said extended operating position.

3. The control knob assembly of claim 2, further comprising means for releasably securing said control knob to said cylindrical drum to maintain said control knob in said retracted, non-operating position.

4. The control knob assembly of claim 2, wherein said moving means includes a ratchet having at least one pin, said pin being engageable with a detent located on said cylindrical drum for releasably coupling said control knob to said cylindrical drum.

5. The control knob assembly of claim 4, wherein said ratchet is removably secured to said control knob.

6. The control knob assembly of claim 4, said cylindrical drum including at least one guide track disposed in an exterior surface thereof.

7. The control knob assembly of claim 6, said at least one guide track including at least one detent engageable by said at least one pin.

8. A control knob assembly for a cooking appliance comprising:

a cylindrical control knob having a depressible, closed end and a second, open end;

said control knob defining an axis and being movable axially and locatable in a first, retracted non-operating position, and a second, extended operating position;

said control knob further being rotatable about said axis when in said extended operating position to permit selection between energized and non-energized positions;

a cylindrical drum slidable within said control knob;

said drum having defined within its outer surface at least one guide track, and;

at least one inwardly projecting guide follower mounted to said control knob said guide track further including a lock point for locking said at least one guide follower and locating said control knob in said retracted position, a release point for releasing said at least one guide follower from said lock point when said control knob is axially depressed, a shunt position located at the forwardmost extreme of said axially extending track, and a ratchet turn point located adjacent said shunt position, said ratchet turn point being engageable by said at least one guide follower for enabling said control knob to energize said cooking appliance, said control knob being rotatable from said shunt position to permit retraction of said control knob from said extended position.

9. A control knob assembly for a cooking appliance comprising:

a cylindrical control knob having a depressible, closed end and a second, open end;

said control knob defining an axis and being movable axially and locatable in a first, retracted non-operating position, and a second, extended operating position;

said control knob further being rotatable about said axis when in said extended operating position to permit selection between energized and non-energized positions;

a cylindrical drum slidable within said control knob;

said drum having defined within its outer surface at least one guide track;

a ring-shaped ratchet mounted at said second, open end of said control knob, said ratchet including at least one inwardly projecting guide follower;

said at least one guide follower being slidable within said guide track between a first detent positioned on said cylindrical drum for securing said control knob in said retracted position, and a shunt position when said control knob is in said extended position;

a second detent positioned on said cylindrical drum for receiving said at least one guide follower when said control knob is depressed for enabling said control knob to energize said cooking appliance;

said control knob being rotatable from said shunt position to permit retraction of said control knob from said extended position.

* * * * *